US006259349B1

(12) United States Patent
Strümpler et al.

(10) Patent No.: US 6,259,349 B1
(45) Date of Patent: Jul. 10, 2001

(54) ELECTRICAL COMPONENT WITH A CONSTRICTION IN A PTC POLYMER ELEMENT

(75) Inventors: Ralf Strümpler, Gebenstorf; Joachim Glatz-Reichenbach, Baden-Dättwil, both of (CH); Erkki Rajala, Vassa (FI); Jorgen Skindhoj, Frederiksberg (DK)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/360,644

(22) Filed: Jul. 26, 1999

(30) Foreign Application Priority Data

Jul. 25, 1998 (DE) ..... 198 33 609

(51) Int. Cl.[7] ..... H01K 7/10
(52) U.S. Cl. ..... 338/22 R; 338/208
(58) Field of Search ..... 338/22 R, 225 D, 338/208

(56) References Cited

U.S. PATENT DOCUMENTS

| | | | | |
|---|---|---|---|---|
| 3,351,882 | | 11/1967 | Kohler et al. . | |
| 4,218,581 | * | 8/1980 | Suzuki | 174/117 F |
| 4,223,209 | * | 9/1980 | Diaz | 338/22 R |
| 4,317,027 | | 2/1982 | Middleman et al. . | |
| 4,352,083 | | 9/1982 | Middleman et al. . | |
| 4,724,417 | | 2/1988 | Au et al. . | |
| 4,884,163 | * | 11/1989 | Deep et al. | 338/22 R |
| 4,951,382 | * | 8/1990 | Jacobs et al. | 338/22 R |
| 5,313,184 | | 5/1994 | Greuter et al. . | |
| 5,414,403 | | 5/1995 | Greuter et al. . | |

FOREIGN PATENT DOCUMENTS

| | | |
|---|---|---|
| 19626238A1 | 1/1998 | (DE) . |
| 0038715B1 | 10/1981 | (EP) . |
| 0655760A2 | 5/1995 | (EP) . |
| 0798750A2 | 10/1997 | (EP) . |
| 4-130602A | 5/1992 | (JP) . |

* cited by examiner

*Primary Examiner*—Karl D. Easthom
(74) *Attorney, Agent, or Firm*—Burns, Doane, Swecker & Mathis, L.L.P.

(57) ABSTRACT

A description is given of a PTC polymer element (1) as part of an electrical component with a novel structure in which aperture angles ($\alpha$) on both sides of constrictions (2) in the PTC polymer material are at least 100°. As a result, an improved response behavior can be achieved, and, in connection with further features, the construction of PTC polymer elements which are more rapid, capable of carrying greater currents and have higher dielectric strengths is possible.

14 Claims, 3 Drawing Sheets

ELECTRICAL COMPONENT WITH A CONSTRICTION IN A PTC POLYMER ELEMENT

BACKGROUND OF THE INVENTION

1. Field of the Invention

The present invention relates to an electrical component with a PTC polymer element. Such components are known, for example, from EP 0 655 760 A2, according to which a PTC polymer element is used for overcurrent limitation and, for this purpose, the PTC polymer element is connected in series with a load interrupter. A current above a threshold value, determined by the design of the PTC polymer element, in this case produces a rapid non-linear rise in the electrical resistance of the PTC polymer element and thereby limits the overcurrents. The load interrupter can then completely interrupt the limited current.

2. Discussion of Background

With respect to the use of PTC polymer elements at relatively high voltages, various possibilities have been proposed in U.S. Pat. Nos. 5,313,184 and 5,414,403 for using resistance systems comprising PTC polymer elements and varistor elements or linear resistor elements for reducing local overvoltages in the PTC polymer material and locally distributing the non-linear response behavior of the PTC polymer material. In connection with the teaching of these two documents, it can be stated that in the case of the present invention the terms PTC polymer element and PTC polymer material definitely also cover such elements and materials to which constituents without PTC behavior, for example linear resistor elements or varistor elements, are added.

Furthermore, this invention relates to such an electrical component in which the PTC polymer element does not have a constant current-carrying cross-sectional area, but instead the line cross-sectional area is constricted. The main direction of flow defining this cross-sectional area is generally dictated by external contacts on the PTC polymer element or by the geometry. At the same time, however, it does not have to correspond to all local directions of flow occurring, but to a certain extent only to their mean value.

Such a constriction of the line cross section has the effect that the current density in relation to the remaining PTC polymer element is locally increased, so that it is predetermined at which point the non-linear rise in resistance of the PTC effect begins when corresponding current threshold values are reached.

EP 0 798 750 A2 in turn shows a resistance system comprising a PTC polymer element with varistor elements in which such constrictions are provided.

U.S. Pat. No. 3,351,882 likewise shows PTC polymer elements with constrictions, giving as the reason for this that, by suitable choice of the constrictions, overheating in the vicinity of the contact points of the PTC polymer element is to be avoided.

Also to be cited as prior art is European Patent EP 0 038 715 B1, in which a very rapid response behavior in the range of a few seconds or less is to be achieved by a specific design of a PTC polymer element with a constriction.

A PTC polymer element with a constriction is also shown, furthermore, by JP 4-130602 with Patent Abstract, DE 196 26 238 A1 as well as U.S. Pat. Nos. 4,317,027 and 4,352,083. The two last-mentioned documents also show in particular that constrictions can be formed by neighboring recesses in a PTC polymer material. In this case, the recesses are filled with an essentially non-conducting material or with air.

SUMMARY OF THE INVENTION

Accordingly, one object of the invention is to provide a novel electrical component with a PTC polymer element in which the PTC polymer element exhibits a particularly rapid response behavior and, in the normally conducting case, a good current-carrying capacity as well as reliable and durable operation.

For this purpose, the invention provides an electrical component with a PTC polymer element which has a constriction of the cross-sectional area perpendicular to a main direction of flow, an aperture angle of the constriction in a longitudinal sectional plane containing the main direction of flow being at least 100°.

The invention thus relates to PTC polymer elements in which the constriction known per se in the prior art runs at a particularly steep angle, in other words has a particularly large aperture angle. It should firstly be stated in this respect that in many cases the constriction is formed only by restricting the cross-sectional area in one direction, in other words the PTC polymer element has as it were a two-dimensional basic structure. To this extent, the definition of the invention relates to an aperture angle in a longitudinal sectional plane through the PTC polymer element, containing the main direction of flow.

There may of course also be a further constriction in a further dimension, perpendicular to the main direction of flow. The invention relates in this case to PTC polymer elements in which the value of 100° for the aperture angle is reached or exceeded in at least one longitudinal sectional plane.

The aperture angle is in this case defined from the perspective of the point of minimum cross section in the constriction, in other words in the sense of spreading out from the point of minimum cross section. Seen from the minimum cross-sectional area, in the longitudinal sectional plane on each side there respectively exists a right-hand aperture angle and a left-hand aperture angle. In the case of the invention, on one side the right-hand aperture angle and the left-hand aperture angle are combined to form a total aperture angle of at least 100°, which however occurs at different apex points in two parts. In this case, the apex points of the two parts of the aperture angle are separated from one another by the transverse extent of the minimum cross-sectional area in the longitudinal sectional plane considered. It is not necessary here for the two parts of the total aperture angle to be identical, but it is preferred. Moreover, according to the invention, the (total) aperture angle must be present at least to one of the two sides, seen from the minimum cross-sectional area, but this preferably applies to both sides.

The length segments on both sides of the constriction that are angled with respect to the main direction of flow and are necessary for the definition of the two parts of the total aperture angle do not necessarily have to be regularly shaped. It is sufficient if a length segment satisfying the angle condition according to the invention can be defined as the mean value. It is preferred, however, for the constriction flanks on both sides of the minimum cross-sectional area to be essentially straight and consequently define the aperture angle overall essentially without mean-value formation. This is because then there cannot be any significant local deviations from the steep formation of the constriction preferred according to the invention.

The value of 100° mentioned for the total aperture angle (that is for example a partial aperture angle to the right of 50° and a partial aperture angle to the left of 50°) forms the lower limit for the invention. In fact, however, even greater aperture angles are more favorable; thus aperture angles of, for example, 105°, 110°, 115° or 120° and above are increasingly preferred.

The effect according to the invention (increasing with greater angles) is that, on the one hand, very rapidly responding PTC polymer elements can be realized, which, on the other hand, exhibit relatively high current-carrying capacities in the non-responding or already responded state.

This is because it has been found in the development of the invention to be important for these two criteria to be satisfied well and as far as possible simultaneously, i.e. on the one hand to realize a great current-carrying capacity with limited overall space provided for the complete electrical component or the PTC polymer element, but on the other hand to be able to design the reduction in the like cross sections for a rapid response behavior. It has been found in this respect that particularly pronounced relative like cross-section reductions produce a particularly rapid response behavior and at the same time, on the other hand, particularly steep constrictions, that is particularly short constriction pieces, exhibit the best current-carrying capacities.

This can presumably be explained by the significantly better cooling effect of short obtuse-angled constrictions in comparison with long, rather more acute-angled constrictions. These at the same time no doubt have the advantage of an improved current-carrying capacity because stability problems or an unintentional response behavior cannot occur due to a thermal build-up under relatively high current loads but below the current threshold value.

In this connection it must also be taken into account that a relatively short overall length of the PTC polymer element in the main direction of flow can be achieved by pronounced, but short constrictions, which reduces the overall ohmic resistance in the normally conducting state. This is important in particular together with the constrictions on particularly small line cross-sectional areas preferred according to the invention.

A further important aspect of the invention is that, with the values according to the invention for the aperture angle, with good current-carrying capacity it is possible to produce constrictions responding so rapidly that, with a series connection of at least two such constrictions a simultaneous response is guaranteed even without parallel connection of a varistor or resistor element and, consequently, a multiplication of the respective dielectric strength of a constriction really is possible.

This is because it has been found in the development of the invention that a series connection of PTC resistor elements with defined response zones is anything but unproblematical. On account of the slightest asymmetries between the various response zones, it is generally the case that one of the response zones responds first and then causes the entire voltage to drop abruptly at this point, in other words fails if the voltage applied is too high. The component is consequently destroyed, and the overcurrent is not limited. Moreover, the series connection of the response points is only disadvantageous, due to an increase in the nominal resistance in the conducting state. Until now, it has only been possible to counter this problem by the parallel connections of varistor or (normal) resistor elements described in the cited prior art.

On the other hand, it has been found that the PTC materials evidently exhibit a certain inherent residual inertia with regard to the heat transfer from the conductive particles typically present in these PTC materials to the polymer matrix, which only induces the actual PTC effect by its reaction to the temperature increase. If the response behavior is significantly more rapid than this inherent inertia, a really simultaneous response of response points or constrictions connected in series can be ensured. This is a particularly important aspect of the invention, because it makes possible a theoretically unlimited increase in the dielectric strength of the overall electrical component.

To utilize fully the addition of the respective dielectric strength of series-connected response points at the constrictions, made possible by the invention, it is also to be preferred to leave such a distance between these constrictions in the main direction of flow that the respective zones of the non-linear response, in other words of the high resistance and the voltage drop, are not connected to one another but remain clearly separated from one another. For this purpose, it is particularly preferred according to the invention that the minimum cross-sectional areas are spaced apart from one another in the main direction of flow by at least twice the minimum extent of the transverse length. Even greater values are to be preferred, that is three times, preferably four times. The minimum extent of the transverse length is intended here to mean the extent of the length transverse to the main direction of flow that marks the point of the smallest line cross-sectional area, in the case of "two-dimensional" constrictions the smaller of the two.

According to a further aspect of the invention, parallel connections of at least two of the constrictions are, moreover, preferred. This has on the one hand the advantage of better mechanical stability, in particular in the case of relatively large overall line cross-sectional areas. On the other hand, the dividing up of the necessary line cross-sectional area into two or more parallel-connected response points also has the advantage of an improved cooling effect, i.e. a better thermal coupling of the response points or the points of the minimum line cross-sectional area to the remaining volume of the PTC polymer element.

In the case of parallel-connected constrictions, it is particularly preferred to arrange them adjacently in such a way that the respective flanks of the constrictions altogether define recesses between the constrictions which, with essentially straight flanks, obtain a rhombus shape. In this respect, reference is made to the exemplary embodiments.

According to the invention, the parallel connections and series connections may also be combined, whereby an array of constrictions is produced. In this case, the extent(s) of the array transversely to the main direction of flow determine(s) the line cross-sectional area and, together with other parameters, the current-carrying capacity, while the "depth" of the -array, that is the number of series connections, determines the dielectric strength.

In all cases of at least two coupled constrictions, that is with parallel connections, series connections and combinations thereof, it is preferred to provide all the constrictions in the same one-piece PTC polymer element, in other words not to let any avoidable material transitions occur between the constrictions.

With regard to the individual constrictions of the line cross-sectional area itself, it is initially envisaged in the case of this invention to carry out the described constriction of the cross-sectional area in only one dimension, that is to reduce the cross section only in one linear dimension contained in the longitudinal sectional plane and not in a longitudinal sectional plane perpendicular thereto, the main direction of flow being contained in both longitudinal sectional planes. This has in particular the advantage of easier production by machining or else by injection-molding or casting processes.

For example, corresponding recesses can be cut out from a solid PTC polymer material by milling or cutting in order to define constrictions, which is very much easier with a two-dimensional structure of the constrictions. In the case of casting or injection-molding processes, at least the production of the molds is made easier, because these are also generally produced by metal-cutting operations. Simplified geometries can also make casting or injection molding easier.

It has been found in the case of the invention that adequately large aperture angles have the effect even with a line cross-sectional constriction in one direction that good combinations of rapidly responding constrictions on the one hand and good current-carrying capacity on the other hand can be achieved.

On the other hand, in the case of electrical components in which the PTC polymer element is to respond very rapidly, constrictions in two directions, that is ultimately three-dimensional forms, have the effect that, in spite of considerable relative reductions in the line cross-sectional area, very small lateral linear dimensions are avoided, which on the other hand facilitates mechanical stability and may also be of advantage during production. Moreover, with such constrictions in two directions, even shorter heat diffusion paths are obtained, and consequently even better cooling, in particular in connection with the already described parallel connection of a plurality of constrictions.

Even if problems of space occur when there is a particularly high necessary current-carrying capacity, a three-dimensional shaping of the constrictions may have the overall effect that a two-dimensional parallel connection of constrictions is also conceivable, so that in connection with an added series connection there can be obtained overall a three-dimensional constriction array, preferably in a one-piece PTC block. In principle, however, this is more complex than an otherwise comparable structure with one-dimensional constrictions.

A further aspect of the invention relates in turn to the dielectric strength, but in this case based already on the individual constriction. Here the invention envisages providing essentially in the main direction of flow a web in the centre of the constriction, in other words a web with essentially the minimum cross-sectional area of the constriction. This web should be extended in the main direction of flow to the extent that—with a length dependent on the respective parameters of the PTC polymer material used—a zone of high resistance can build up completely in the region of the minimum cross-sectional area. This is because, if the cross-sectional area is widened too early, it is possible that there is no longer any current density causing a response of the PTC polymer material in the widened region, so that the extent of the zone of high resistance in the main direction of flow is limited by the geometry and not by the material properties and the electrical parameters. With the solution according to the invention, however, the zone of high resistance can build up over the entire length and consequently the maximum dielectric strength that can be respectively achieved for the individual constriction can build up.

In this respect, a region between 0.5 and 4 mm, preferably between 1 and 2 mm, is typically to be provided for the extent of the web in the main direction of flow. Excessive web lengths are disadvantageous, because they can impair the cooling effect essential for the invention.

Furthermore, constrictions which restrict relatively severely the line cross-sectional area perpendicularly to the main direction of flow, to be precise by at least a factor of 3, preferably 4 or 5, have been found to be advantageous in the case of the invention, in particular with regard to the rapid response behavior. As already mentioned, a division into at least two parallel-connected constrictions is advantageous if only for stability reasons and, moreover, because of the shorter thermal diffusion paths. This applies in particular to very strong reductions in line cross-sectional area. The exemplary embodiments expand this point.

A preferred material for the PTC polymer element is the material "ETTB", which consists for example of 50% ETFE and 50% $TiB_2$. Here, ETFE is an abbreviation for the polymer material ethylene-tetra-fluoro-ethylene. Further explanations of the invention will be given below with reference to the exemplary embodiments. Individual features disclosed thereby may also be essential for the invention in different combinations.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
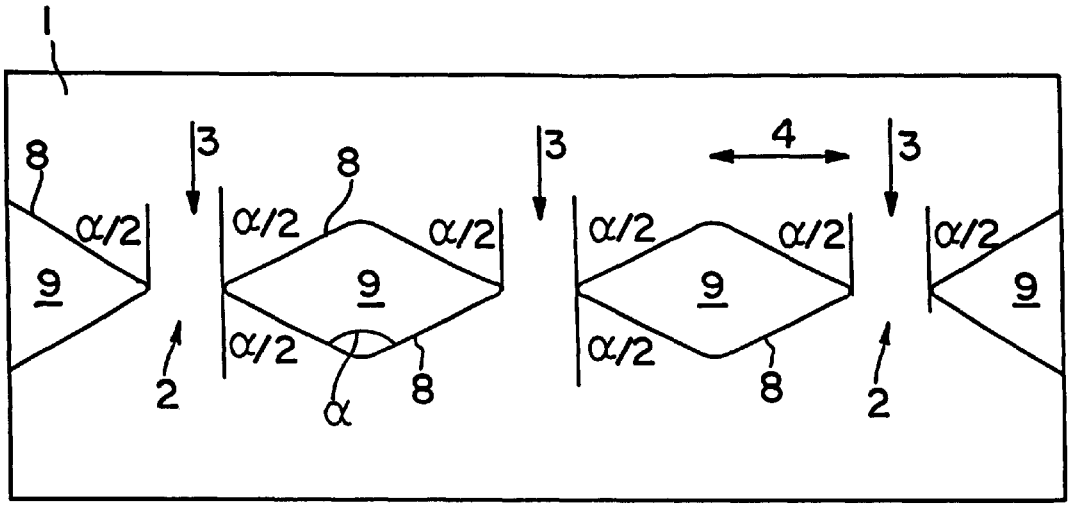
FIG. 1 shows a schematic view of a PTC polymer element with three constrictions according to the invention in parallel connection.

The invention relates to an electrical component with a PTC polymer element. The exemplary embodiments show PTC polymer elements for electrical resistors as a specific variant of an electrical component. These electrical resistors are used as current-limiting devices in automatic circuit-breakers. Other electrical components may of course be provided in a similar way with PTC polymer elements in order to utilize the PTC effect for specific electrotechnical purposes. Since electrical resistors with PTC polymer elements are as- such state of the art, only the PTC polymer elements themselves are shown and explained below. The connection to external contacts and use in an external electrical configuration are known to a person skilled in the art without further explanations. The views represented in FIGS. 1 to 4 in this case correspond to a cross-sectional profile which retains the PTC polymer element 1 also over its thickness in the dimension perpendicular to the plane of the drawing; it is thus a "two-dimensional structure". In the case of this example, the thickness of the structure in this third dimension is 1.5 mm, but may also be readily changed.

Accordingly, all the cross-sectional areas change proportionately, and consequently so too does the current-carrying capacity.

DESCRIPTION OF THE PREFERRED EMBODIMENTS

Referring now to the drawings, wherein like reference numerals designate identical or corresponding parts throughout the several views, in FIG. 1 there is shown a PTC polymer element 1, which is designed for a main direction of flow 3, as indicated by the arrows, in other words in the figure vertically from top to bottom (or from bottom to top).

Accordingly, FIG. 1 shows a longitudinal sectional plane which contains the main direction of flow 3. Provided in this longitudinal sectional plane, horizontally next to one another in the sense of the figure, are three constrictions 2, identical apart from their respective position in the PTC polymer element 1. These constrictions are formed by two air-filled recesses 9 in the solid material that are rhombic in the longitudinal sectional plane and two further recesses 9 on the right and left at the edge (in the sense of notches) of the solid material. As already explained further above, the aperture angle $\alpha$, essential for the invention, is divided on both respective sides of a constriction 2 in each case into two parts, which in the present case are of equal size. This means in actual fact that the angle between a straight flank 8 of one of the altogether four recesses 9 and the main direction of flow, seen from the constriction 2, (as denoted in the figure by $\alpha/2$) is 60°, and the total aperture angle is consequently 120°. Accordingly, the angles in the recesses are laterally in each case 60° and in the case of the recesses 9 in the center of the PTC polymer element 1 120° at the top and bottom.

With a total width of the PTC polymer element 1 represented of 40 mm, the smallest line cross-sectional areas 7 in the constrictions 2 are in each case 2 mm in width and are separated from one another by the width of a recess 9 in the solid material of 11 mm.

Figure 2:
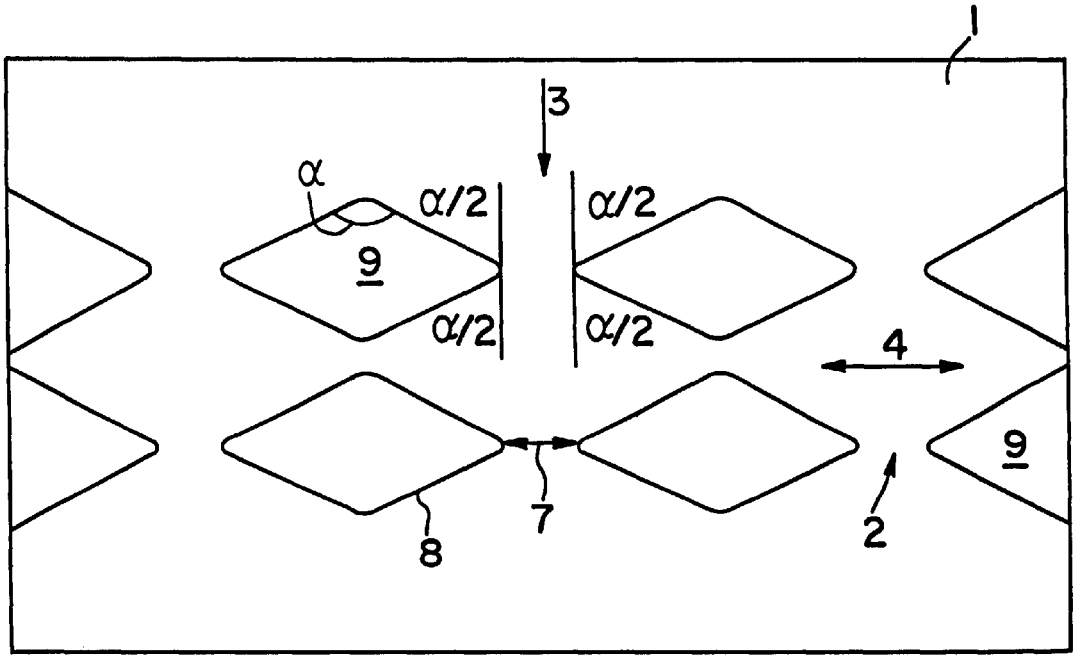
FIG. 2 shows a view of a further PTC polymer element according to the invention, which essentially corresponds to an integrated series connection of two PTC polymer elements according to FIG. 1.

FIG. 2 shows a structure largely corresponding to FIG. 1, in which however the system of constrictions 2 and recesses 9 represented in FIG. 1 is provided twice and lying one behind other in the main direction of flow 3. In this case, the constrictions 2 and recesses 9 lie in line one behind the other in the (vertical) main direction of flow 3. The distance 10 between the points of the smallest cross-sectional areas 7 in the main direction of flow 3 is approximately 8 mm in the case of the structure in FIG. 2. This distance of 8 mm is consequently four times the minimum transverse extent of the constrictions 2 of 2 mm.

Figure 3:
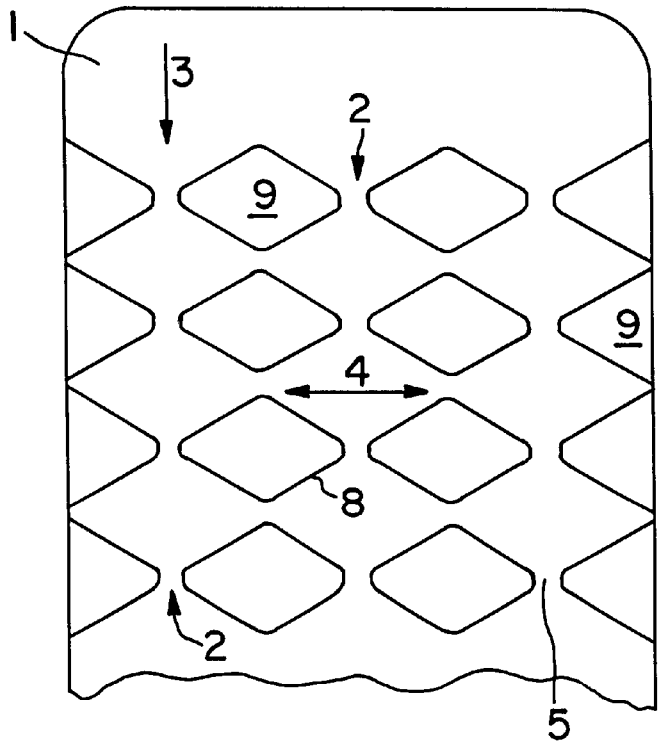
FIG. 3 shows a view of a further PTC polymer element according to the invention with a greater number of series-connected constrictions, three constrictions in each serial stage being respectively connected in parallel and there being a number of geometrical deviations in comparison with FIGS. 1 and 2.

FIG. 3 shows an exemplary embodiment changed in three aspects in comparison with FIG. 2. Firstly, a series connection of in each case two constrictions 2 has become a series connection of a multiplicity of constrictions 2 in each "column" of the parallel connection, only the respectively uppermost four constrictions being represented. Furthermore, in the case of this exemplary embodiment all the largely sharp corners in the structures from FIG. 1 and FIG. 2 are somewhat rounded-off, which makes the machining of a PTC polymer block or a mold for an injection-molding or casting process significantly easier in certain respects. These rounded-off portions do not change anything important with respect to the way in which the geometry represented functions.

Finally, the points of minimum line cross-sectional area 7 are extended to form webs 5, which extend over a length 6 in the main direction of flow 3. This can be seen better in the representation of a detail in FIG. 4. The length 6 of the webs 5 is 1 mm, without including the curvature where the aperture angle begins, between 1 and 2 mm if part of this curvature is taken into consideration. Accordingly, the distance 10 between the points of minimum cross section 7 in the main direction of flow 3 is 1 mm longer in the case of this exemplary embodiment than in FIG. 2, if it is in each case calculated from the middle of the web; the web length is thus provided in addition to this distance (supplement reference numeral 10). The other dimensions correspond to the values specified above.

Figure 4:
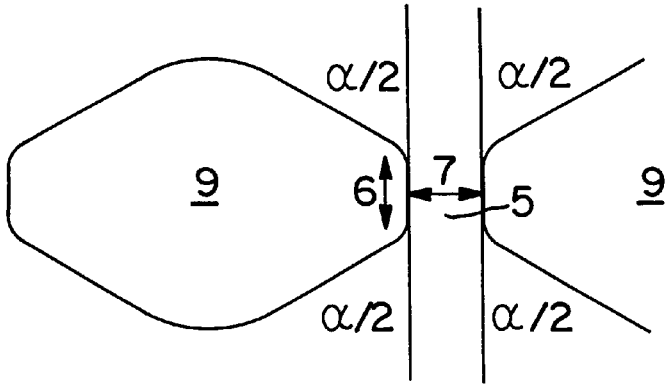
FIG. 4 shows a representation of a detail of a constriction and a recess from FIG. 3.
Figure 5A:
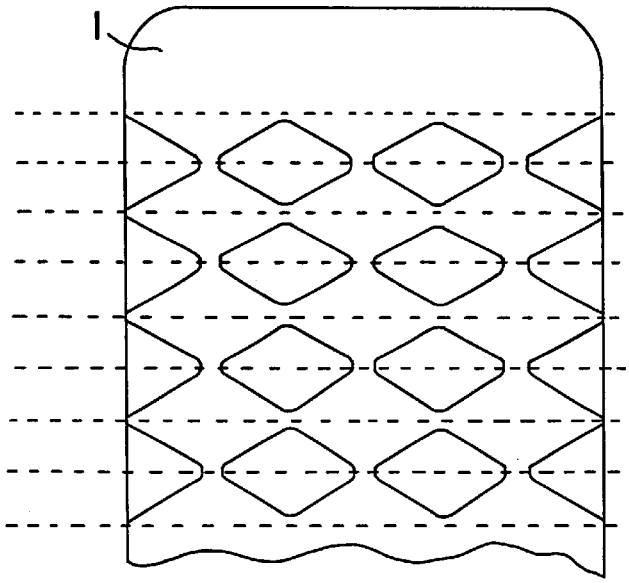
FIG. 5 shows a combination of a view corresponding to FIG. 3 of a "three-dimensional" array of constrictions in a PTC polymer element according to the invention with a side view with respect thereto.
Figure 5B:
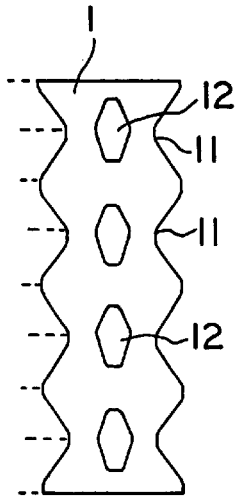

FIG. 5 shows a further variation. In this case, the dimension perpendicular to the plane of the drawing of FIGS. 3 and 4 is also used for the structuring of the constrictions; a "three-dimensional constriction structure" is thus concerned. In the left-hand part, FIG. 5 shows a plan view of this figure, which to this extent corresponds identically to FIG. 3. However, the surface and the underside of this PTC polymer element 1 are corrugated, i.e. have lateral recesses or notches 11 also on the upper side and underside. There are correspondingly also in this "third dimension" recesses 12 in the solid material of the PTC polymer element 1. The wave-like recesses 11 on the upper side and underside and the recesses 12 in the solid material synchronously complement the recesses 9 already described on the basis of FIGS. 3 and 4, thus have as it were the same frequency and the same phase (cf. in this respect the broken auxiliary lines in FIG. 5). As a result, the relative reduction in area at the constrictions 2 is to a certain extent intensified by a factor additionally obtained in the third dimension. For this reason it is not absolutely necessary for the aperture angles, analogous to the above definition, of the further longitudinal sectional plane in the right-hand side in FIG. 5 to have values of at least 100°.

In the case of the structures from FIGS. 1, 2, 3 and 4, reductions in the line cross-sectional area to 15% of the maximum line cross-sectional area, in the case of the structure from FIG. 5 even to 5%, are thereby obtained. It is clear that the respectively indicated strings of constrictions 2 can be continued as desired as a series connection in the main direction of flow 3 and as a parallel connection in the direction perpendicular thereto, lying in the plane of the drawing of FIGS. 1–4, as well as in the third direction in FIG. 5. Basically concerned is an essentially regular grid of constrictions which can be adapted in a suitable way according to requirements to the overall geometry, to the dielectric strength and to the current-carrying capacity. Moreover, a plurality of plate-like PCT polymer elements 1 according to FIGS. 1–5 may also be connected in parallel in an electrical component. As a result, a great current-carrying capacity can be achieved with at the same time simple production of the individual plates.

As already mentioned, the PTC polymer element is in this case produced from the material ETTB comprising 50% ETFE and 50% $TiB_2$. In the case of the exemplary embodiments represented here, the material was milled or cut out from a block, although various injection-molding and casting processes according to the prior art are also conceivable for large-scale production. In this case under certain circumstances the corresponding metal contacts can the formed on in one operation.

It is clear here that the structure represented in FIG. 5 necessitates a somewhat more complicated production. On the other hand, it offers yet further improved response behavior in comparison with the other structures.

Furthermore, the structures according to FIGS. 3, 4 and 5 are improved in comparison with the structures in FIGS. 1 and 2 with regard to dielectric strength in the response state by the formation of the constrictions 2 in the described web form. Depending on the material, a typical value for a single constriction 2 in this case lies in the range of 150–300 V (root-mean-square value). For a typical application, a low-voltage fuse system in the range of, for example, 690 V, accordingly a plurality of series-connected constrictions 2, at most five, are necessary.

Figure 6:
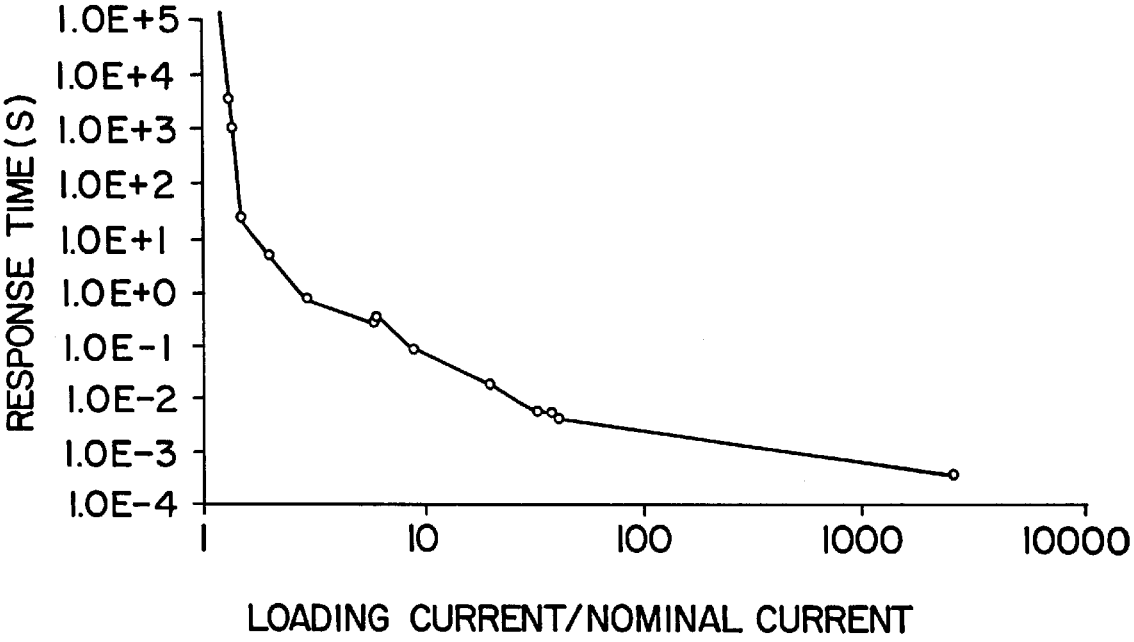
FIG. 6 shows a diagram of the relationship between the response time and the loading current for a resistor according to the invention.

To illustrate the response behavior, FIG. 6 shows measured values on a test specimen of the structure from FIG. 2, to be precise for the response time on the y-axis against the quotient of the actual loading current and the maximum design current in the normally conducting state. It can be seen that, when there are small overcurrents, the curve rises to greatly prolonged response times, in other words the PTC polymer element 1 responds only slowly in the range of small multiples of the nominal current. This behavior is in principle typical of PTC polymer materials; in the case of the specimen according to the invention, the response behavior in the direct vicinity, approximately below 1.3 times the nominal current, is however even slower than in the case of conventional comparative elements. This clearly illustrates the improved cooling effect on account of the geometry according to the invention, which makes possible continuous loading near to the nominal current for a longer time.

On the other hand, the response behavior of the PTC polymer element 1 according to the invention above a value approximately 1.3 to 2 times the nominal current is considerably more rapid, to be precise more rapid by 1–2 powers of ten, than in the case of conventional examples. This applies approximately up to 100 times the nominal current; after that, the specimen according to the invention is still better than the prior art, but its superiority diminishes.

Finally, it is pointed out that the simultaneous response of series-connected constrictions according to the invention was verified by means of infrared frame camera exposures.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An electrical component comprising:

a PTC polymer element and external contacts applied to the PTC polymer element and defining a main direction of a current flow in a section of the PTC polymer element, the section of the PTC polymer element comprising a plurality of rhombic recesses in the PTC polymer element and at least one constriction formed in the material of the PTC polymer element and extending perpendicular to the main direction of the current flow;

wherein in a longitudinal sectional plane extending parallel to the main direction of the current flow, each at least one constriction is formed between two of the plurality of rhombic recesses, wherein a) first and second opposite vertices of each of the two rhombic recesses are aligned parallel to the main direction of the current flow, b) the third and fourth opposite vertices of each of the two rhombic recesses are aligned along a single axis perpendicular to the main direction of current flow so that the narrowest part of the constriction lies between the two rhombic recesses along the single axis perpendicular to the main direction of current flow, and c) an angle of each of the first and second opposite vertices of each of the two rhombic recesses is greater than 100°.

2. The electrical component as claimed in claim 1, in which the angle of each of the first and second opposite vertices is at least 110°.

3. The electrical component as claimed in claim 1, wherein at least one constriction comprises at least two constrictions located along a single axis parallel to the direction of the current flow, and thereby connected in series with respect to the current flow.

4. The electrical component as claimed in claim 3, in which minimum cross-sectional areas of the series-connected constrictions are spaced apart from one another in the main direction of the current flow by at least twice a minimum width of the cross-sectional areas, wherein the minimum width is measured in a direction perpendicular to the main direction of the current flow.

5. The electrical component as claimed in claim 1, wherein the at least one constriction comprises at least two constrictions located along a single axis perpendicular to the direction of the current flow, and thereby connected in parallel with respect to the current flow.

6. The electrical component as claimed in claim 3, in which the constrictions are formed in the same one-piece PTC polymer element.

7. The electrical component as claimed in claim 1, wherein the at least one constriction reduces the cross-sectional area in only one linear dimension contained in the longitudinal sectional plane.

8. The electrical component as claimed in claim 1, wherein a portion of the at least one constriction that has a minimum cross-sectional area of the at least one constriction, extends in the main direction of the current flow.

9. The electrical component as claimed in claim 8, wherein the portion of the at least one constriction extends between 0.5 mm and 4 mm in the main direction of the current flow.

10. The electrical component as claimed in claim 1, wherein the at least one constriction reduces the cross-sectional area perpendicularly to the main direction of flow by at least a factor of 3.

11. The electrical component as claimed in claim 1, in which the material of the PTC polymer element comprises 50% ethylene-tetra-fluoro-ethylene and 50% $TiB_2$.

12. The electrical component of claim 9, wherein the portion of the at least one constriction extends between 1 millimeter and 2 millimeters in the main direction of the current flow.

13. The electrical component of claim 10, wherein the constriction reduces the cross-sectional area perpendicularly to the main direction of flow by at least a factor of 4.

14. The electrical component of claim 10, wherein the constriction reduces the cross-sectional area perpendicularly to the main direction of flow by at least a factor of 5.

* * * * *